US011591547B2

(12) United States Patent
Xue et al.

(10) Patent No.: US 11,591,547 B2
(45) Date of Patent: Feb. 28, 2023

(54) BIODEGRADABLE CLEANING COMPOSITION

(71) Applicant: EVONIK OPERATIONS GMBH, Essen (DE)

(72) Inventors: Zheng Xue, Henrico, VA (US); Andras Nagy, Chester, VA (US); Dennis Parrish, Sandston, VA (US); Sam Christy, Selbyville, DE (US); Jennifer Goodyear, Chester, VA (US); Jeff Davidson, Beaverdam, VA (US)

(73) Assignee: Evonik Operations GmbH, Essen (DE)

( * ) Notice: Subject to any disclaimer, the term of this patent is extended or adjusted under 35 U.S.C. 154(b) by 74 days.

(21) Appl. No.: 16/608,791

(22) PCT Filed: Apr. 26, 2018

(86) PCT No.: PCT/EP2018/060751
§ 371 (c)(1),
(2) Date: Oct. 25, 2019

(87) PCT Pub. No.: WO2018/197623
PCT Pub. Date: Nov. 1, 2018

(65) Prior Publication Data

US 2020/0199492 A1 Jun. 25, 2020

Related U.S. Application Data

(60) Provisional application No. 62/490,637, filed on Apr. 27, 2017.

(30) Foreign Application Priority Data

May 10, 2017 (EP) ..... 17170356

(51) Int. Cl.
*C11D 1/02* (2006.01)
*C11D 1/66* (2006.01)
(Continued)

(52) U.S. Cl.
CPC ..... *C11D 1/83* (2013.01); *C11D 1/06* (2013.01); *C11D 1/37* (2013.01); *C11D 1/65* (2013.01); *C11D 1/667* (2013.01); *C11D 1/94* (2013.01)

(58) Field of Classification Search
CPC .. C11D 1/02; C11D 1/66; C11D 1/667; C11D 1/88; C11D 3/02; C11D 3/38
See application file for complete search history.

(56) References Cited

U.S. PATENT DOCUMENTS 4,305,961 A 12/1981 Tsutsumi et al.
5,520,839 A 5/1996 Hall et al.
(Continued)

FOREIGN PATENT DOCUMENTS

CN 1337439 2/2002
CN 103 773 614 5/2014
(Continued)

OTHER PUBLICATIONS

U.S. Appl. No. 15/548,602, filed Aug. 3, 2017, US-2018/0023040 A1, Jan. 25, 2018, Schilling, et al.
(Continued)

*Primary Examiner* — Brian P Mruk
(74) *Attorney, Agent, or Firm* — Law Office of Michael A. Sanzo, LLC

(57) ABSTRACT

The present invention is directed to biodegradable cleaning compositions, in particular hard surface cleaning compositions, and their use. The compositions according to the invention comprise one or more biosurfactants(s), one or
(Continued)

more sorbitan ester(s) and one or more further surfactant(s), which is/are neither a biosurfactant nor a sorbitan ester.

20 Claims, 4 Drawing Sheets

(51) Int. Cl.

| | |
|---|---|
| ***C11D 1/88*** | (2006.01) |
| ***C11D 3/02*** | (2006.01) |
| ***C11D 3/38*** | (2006.01) |
| ***C11D 1/83*** | (2006.01) |
| ***C11D 1/06*** | (2006.01) |
| ***C11D 1/37*** | (2006.01) |
| ***C11D 1/65*** | (2006.01) |
| ***C11D 1/94*** | (2006.01) |

(56) References Cited

U.S. PATENT DOCUMENTS

| | | | | |
|---|---|---|---|---|
| 5,654,192 | A | 8/1997 | Ducreux et al. | |
| 7,125,825 | B2 | 10/2006 | Moss | |
| 7,556,654 | B1 | 7/2009 | Nero | |
| 7,985,722 | B2 | 7/2011 | DeSanto | |
| 8,361,953 | B2 | 1/2013 | Nagy et al. | |
| 8,883,713 | B2 | 11/2014 | Parrish et al. | |
| 9,243,212 | B2 | 1/2016 | Kuppert et al. | |
| 9,271,908 | B2 | 3/2016 | Allef et al. | |
| 9,351,485 | B2 | 5/2016 | Giessler-Blank et al. | |
| 10,292,924 | B2 | 5/2019 | Schilling et al. | |
| 10,544,384 | B2 | 1/2020 | Scheuermann et al. | |
| 10,604,722 | B2 | 3/2020 | Schilling et al. | |
| 2004/0171512 | A1 | 8/2004 | Develter et al. | |
| 2012/0328790 | A1 | 12/2012 | Nagy et al. | |
| 2016/0174550 | A1* | 6/2016 | Daigle | A01N 65/22 514/731 |
| 2016/0249604 | A1 | 9/2016 | Giessler-Blank et al. | |
| 2017/0071835 | A1* | 3/2017 | Schelges | A61Q 5/02 |
| 2017/0306264 | A1 | 12/2017 | Peggau et al. | |
| 2018/0023040 | A1 | 1/2018 | Schilling et al. | |
| 2018/0155604 | A1 | 6/2018 | Smith et al. | |
| 2019/0031977 | A1 | 1/2019 | Kuppert et al. | |
| 2019/0256542 | A1 | 8/2019 | Lu et al. | |
| 2019/0269158 | A1 | 9/2019 | Schilling et al. | |
| 2019/0307657 | A1 | 10/2019 | Wenk et al. | |
| 2019/0322919 | A1 | 10/2019 | Smith et al. | |

FOREIGN PATENT DOCUMENTS

| | | |
|---|---|---|
| CN | 103773614 | 5/2014 |
| CN | 104962238 | 10/2015 |
| DE | 196 00 743 | 7/1997 |
| DE | 196 48 439 | 5/1998 |
| EP | 0 499 434 | 8/1992 |
| EP | 1 445 302 | 8/2004 |
| EP | 2 786 742 | 4/2013 |
| FR | 2 740 779 | 5/1997 |
| FR | 2 855 752 | 12/2004 |
| JP | 60-183032 | 9/1985 |
| JP | 01-304034 | 12/1989 |
| JP | 2006-070231 | 3/2006 |
| JP | 2006-083238 | 3/2006 |
| JP | 2006-274233 | 10/2006 |
| JP | 2007-181789 | 7/2007 |
| JP | 2008-062179 | 3/2008 |
| KR | 20040033376 | 4/2004 |
| WO | WO 03/006146 | 1/2003 |
| WO | WO 2018/197623 | 11/2018 |
| WO | WO 2019/154970 | 8/2019 |

OTHER PUBLICATIONS

U.S. Appl. No. 16/077,556, filed Aug. 13, 2018, US-2019/0031977 A1, Jan. 31, 2019, Kuppert, et al.
U.S. Appl. No. 16/075,298, filed Aug. 3, 2018, US-2019/0256542 A1, Aug. 22, 2019, Lu, et al.
U.S. Appl. No. 16/332,979, filed Mar. 13, 2019, US-2019/0269158 A1, Sep. 5, 2019, Schilling, et al.
U.S. Appl. No. 16/470,411, filed Jun. 17, 2019, US-2019/0307657 A1, Oct. 10, 2019, Wenk, et al.
U.S. Appl. No. 15/509,685, filed Mar. 8, 2017, US-2017-0306264 A1, Oct. 26, 2017, Peggau.
European Search Report and Search Opinion for corresponding EP 17 17 0356 filed May 10, 2017.
U.S. Appl. No. 15/831,152, filed Dec. 4, 2017, US-2018/0155604 A1, Jun. 7, 2018, Smith.
U.S. Appl. No. 16/467,631, filed Jun. 7, 2019, US-2019/0322919 A1, Oct. 24, 2019, Smith.
Li, et al., "Microbial synthesis and latest applications of Sophorolipidase," *Applied Chemical Industry* 42(2):363-366 (Feb. 2013).
International Search Report for corresponding PCT/EP2018/060751, filed Apr. 26, 2018.
Written Opinion of the International Searching Authority for corresponding PCT/EP2018/060751 filed, Apr. 26, 2018.
International Preliminary Report on Patentability for corresponding PCT/EP2018/060751 filed, Apr. 26, 2018.

* cited by examiner

Test equipment used for cleaning performance tests

Test Results for Example 1 as photo of the real samples and evaluated as whiteness after cleaning, rated on a 0-100 scale (from left to right: Example 1 (1a), Comparison Example 1 (1b), Comparison Example 2 (1c)).

Test results for Example 2 evaluated as whiteness after cleaning, rated on a 0-100 scale (#1 = Reference Cleaner 1; #2 = Reference Cleaner 2; #3 = Reference Cleaner 3; #4 = Example 2).

Test results of Example 4 as photo of the real samples and evaluated as whiteness after cleaning, rated on a 0-100 scale (from left to right 4a, 4b and 4c)

Test results of Example 5 as photo of the real samples and evaluated as whiteness after cleaning, rated on a 0-100 scale (from left to right 5a, 5b and 5c)

Test Results of Example 10 as photo of the real samples and evaluated as whiteness after cleaning, rated on a 0-100 scale (#1 = 10a; #2 = 10b)

Test Results of Examples 11 and 12 as photo of the real samples and evaluated as whiteness after cleaning, rated on a 0-100 scale (from left to right: a = Comparative Example 4, b = Comparative Example 5, c = Comparative Example 6, d = Comparative Example 7, e = Comparative Example 8, f = Example 12a, g = Example 1 as reference; h = Example 12b)

BIODEGRADABLE CLEANING COMPOSITION

CROSS REFERENCE TO RELATED APPLICATIONS

The present application is US national stage of international application PCT/EP2018/060751, which had an international filing date of Apr. 26, 2018, and which was published on Nov. 1, 2018. The application claims the benefit of U.S. provisional application 62/490,637, filed on Apr. 27, 2017 and priority to EP 17170356.4, filed on May 10, 2017, both of which are hereby incorporated by reference in their entirety.

FIELD OF THE INVENTION

The present invention is directed to biodegradable cleaning compositions, in particular hard surface cleaning compositions, and their use. The compositions according to the invention comprise one or more biosurfactant s(s), one or more sorbitan ester(s) and one or more further surfactant(s), which is/are neither a biosurfactant nor a sorbitan ester.

BACKGROUND OF THE INVENTION

The industry standard practice when formulating hard surface cleaners usually utilizes high pH that saponifies oily deposits as an effective tool to obtain cleaning efficacy. The generated soaps, as well as the elevated electrostatic repulsion forces at high pH condition is of vital importance to impart acceptable cleaning efficacy. Although effective in terms of improving cleaning efficacy, the high pH causes many potential problems. For example, in offshore cleaning, environmental regulations prohibit the discharge of some of high pH cleaners directly to the ocean. The pH has to be controlled within a legally allowed range to discharge. Also, high pH is not favorable for skin mildness, since conventional high pH cleaners would remove the protective oil layer on the surface of the skin. Therefore, a cleaning formulation with good cleaning performance at mild pH range is desired for such applications.

A consumer conception about green cleaners with good environmental profiles is that these products usually lack the cleaning power as conventional cleaners. The reasons that lead to the ineffectiveness of most of the green products originated from either poorly formulated compositions or limited ingredients they can choose from.

EP 0499 434 and EP 1 445 302 disclosed utilization of synergistic interactions between surfactant blends of micellar phase surfactant and lamellar phase surfactant to improve the cleaning performance. In detail EP 0 499 434 discloses the improved oily soil detergency in fabric washing of a detergent composition comprised of one micellar phase surfactant and one lamellar phase surfactant, with at least one of the surfactants is a glycolipid biosurfactant. The micellar and lamellar phase surfactant is distinguished by the behavior of 1% aqueous surfactant solution. A surfactant solution exhibited birefringent textures under polarized light is defined as lamellar phase surfactant, while a micellar phase surfactant does not. The glycolipid biosurfactants alone are poor detergents, while the addition of a non-glycolipid surfactant improves the detergency in fabric washing. U.S. Pat. No. 5,520,839 discloses the same set of invention, claiming detergent composition suitable for washing fabrics containing surfactant system and builder.

EP 1 445 302/US 2004 01 5261 3 discloses a detergent composition comprising at least one glycolipid biosurfactant and at least one non-glycolipid surfactant in the micellar phase. Foam quality when used in combination with various nonionic surfactants and also anionic surfactant was investigated. Both surfactants are in the micellar phase, which is defined as exhibiting soluble and transparent aqueous phase behavior at 1% surfactant active concentration. The cleaning performance of these detergent compositions can still be improved.

DE 196 48 439 & DE 196 00 743 describe the use of a mixture of glycolipids and a long list of possible anionic surfactants for dish washing.

U.S. Pat. No. 5,654,192 discloses compositions containing an anionic and/or nonionic surfactant, and at least one glycolipid. The composition is used for decontaminating a polluted porous medium. There are specific examples using combinations of sodium dioctyl sulphosuccinate and sophorolipids showing the synergistic effect on lowering of interfacial tension. Neither foaming, nor mildness to human skin is mentioned. No aqueous concentrated composition is disclosed.

JP 2006070231 A, discloses a biodegradable liquid cleaning composition e.g. liquid body cleaning composition for jet washing. The composition contains sophorolipids comprising 90% or more acid-type sophorolipids. These formulations are insufficient for heavy oil cleaning.

KR 2004033376 A, describes a cosmetics composition comprising sophorolipids. The cosmetic composition has excellent sterilization effect as well as moisturizing and softening effects on the skin. The composition is formulated into face lotion, nutritive emulsion, face cream and the like. These formulations are not suitable for hard surface cleaning and heavy oil cleaning.

WO 2016050439, discloses a formulation containing at least one biosurfactant and at least one secondary surfactant from betaines, alkoxylated fatty alcohol sulfates and alkyl amine oxides. The formulation is demonstrated to have high degreasing power and high foaming capability.

WO 2013098066, discloses compositions for hair and skin cleaning, in particularly for the cleaning and care of human or animal body parts, especially skin and hair for hide or feathers. The compositions comprise one or more biosurfactants, one or more fatty acids, and water. The compositions can be e.g. cleaning or care formulations, such as e.g. shampoos, conditioners, shower gels, body cleaning compositions or skin cleaning compositions but are not suitable for use in the applications in focus of the present invention.

CN 103 773 614 discloses biological slim removers for circulating cooling waters. The slim removers contain hydrophilic polysorbate nonionic surfactants with HLB values of from 14.9 to 16.7 as well as a biosurfactant and a penetrating agent. The nature of biological slim is drastically different from that of oily soil. Therefore, removal of biological slim from a cooling water system has nothing to do with heavy oily soil removal from hard surfaces and the slim remover disclosed in CN 103 773 614 cannot be used to solve the problem of the present invention.

As discussed above, several biodegradable cleaning compositions using biosurfactants are known for different applications. It becomes clear that for specific applications specific cleaning compositions are needed. For cleaning hard surfaces, e.g. from heavy oil impurities, and in particular for use in off shore applications new mild and biodegradable cleaning compositions with improved properties are needed.

SUMMARY OF THE INVENTION

An object of the present invention, thus, was to provide cleaning compositions, which do not have one or more of the disadvantages of the known formulations or which do have the disadvantages of the known formulations only to a reduced extent. The compositions according to the invention should preferably be biodegradable to the greatest possible extent, should be usable at mild pH and should have excellent cleaning performance properties.

Further objects that are not explicitly described become obvious from the context of the description, examples, figures and claims of this invention.

Surprisingly the inventors found out that compositions as defined in the claims and described below, solve one or more of the stated problems.

The inventors found out that by blending sorbitan esters, which usually are insoluble in water, with at least one biosurfactant and at least one further surfactant that is neither a biosurfactants nor a sorbitan ester, cleaning compositions can be obtained that show improved cleaning performance at mild pH.

Without being bond to any theory, the inventors are of the opinion that the rather hydrophobic sorbitan esters help to increase the overall hydrophobicity of the formulation and therefore boost the cleaning properties for heavy oils such as petro-base oils. In an appropriate formulation, as claimed in claim 1, the hydrophilicity of the biosurfactants, which alone would deteriorate the cleaning performance, can be compensated.

To achieve optimum cleaning performance and aqueous stability a third surfactant is comprised in the compositions of the invention.

Beside of their excellent cleaning properties, the compositions of the present invention show one or more of the below mentioned additional benefits.

Sorbitan esters are less expensive as biosurfactants, in particular as sophorolipids. By use of the sorbitan esters, the amount of biosurfactants could be reduced and thus, an economical advantage achieved. Sorbitan esters are biodegradable and are obtainable from plants. Thus, the environmental profile of this type of surfactant is better than that of conventional surfactants.

The compositions of the present invention can be formulated at mild pH and are biodegradable. They meet the requirements of environmental regulations like the regulations on biodegradability OECD 301 and Regulation (EC) No. 648/2004 of the European Parliament and of the Council on detergents of Mar. 31, 2004. They can be used for example in offshore cleaning applications. The mild pH value also ensures that the formulations of the present invention are favorable for the skin of the persons using them.

Another economical as well as environmental benefit of the compositions of the invention is that they can be prepared without use of a volatile organic solvent or with water as the sole solvent. Even though it is not excluded, use of volatile organic solvents is usually not necessary.

Other disadvantages of prior art cleaning compositions like stress cracking of polycarbonate could also be overcome.

The cleaning compositions of the present invention are based as far as possible and may be based entirely on natural raw materials.

BRIEF DESCRIPTION OF THE DRAWINGS

FIG. 4 shows test results from Example 5.

FIG. 4 shows test results from Example 10.

FIG. 4 shows test results from Examples 11 and 12.

DETAILED DESCRIPTION OF THE INVENTION

Figure 1:
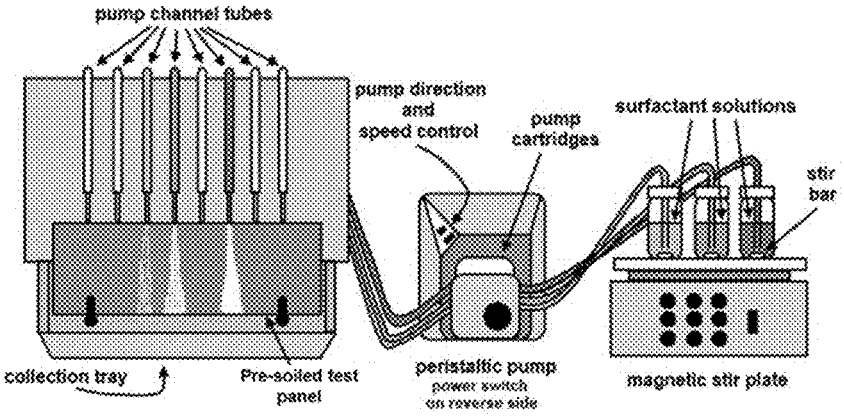
FIG. 1 shows a multi-channel peristaltic pump flow system used for cleaning tests.

The compositions according to the invention and uses thereof are described below by way of example without any intention of limiting the invention to these exemplary embodiments. Wherever ranges, general formulae or compound classes are given below, then these are intended to include not only the corresponding ranges or groups of compounds that are explicitly mentioned, but also all part ranges and part groups of compounds which can be obtained by removing individual values (ranges) or compounds. Wherever documents are cited within the context of the present description, then their contents, in particular as regards the substantive matter to which reference is made, are deemed as belonging in their entirety to the disclosure content of the present invention. Where average values are stated herein below, then, unless stated otherwise, these are number-averaged average values. Unless stated otherwise, percentages are data in percent by weight. Wherever measurement values are stated herein below, then, unless stated otherwise, these have been determined at a temperature of 25° C. and a pressure of 1013 mbar.

The cleaning compositions of the present invention comprise as component A) a mixture of surfactants. Fraction of the sum of all surfactants (Component A) in the overall composition is preferably in a range of from 0.1 to 100% by weight. If component A) does not form 100% by weight the total composition of the present invention, the composition contains one or more additional components as described further below. Preferred, as additional component is water (Component B). If an additional component is comprised in the composition of the invention, the fraction of the sum of all surfactants in the overall composition is preferably 0.1% to 50% by weight, more preferred 0.3% to 30% by weight, even more preferred 0.5% to 10% by weight, particular preferred 0.5% to 5% by weight and most preferred 1% to 3% by weight.

Component A), i.e. the mixture of surfactants, comprises three different surfactants or mixtures of surfactants. These are:

A1) one or more biosurfactants(s)

A2) one or more sorbitan ester(s)

A3) one or more further surfactant(s) which is/are neither a biosurfactant A1) nor a sorbitan ester A2).

The sorbitan esters used as components A2) must have a minimum hydrophobicity to ensure high cleaning performance in the fields of application of the present invention and in particular for heavy oil soils. An indicator for the hydrophobicity of a sorbitan ester is its HLB value. In the compositions of the present invention sorbitan esters with an HLB value below or equal to 11, preferably below or equal to 10, more preferred HLB value of from 4 to 10, are used. Any kind of sorbitan ester having such HLB value can be used. Preferred sorbitan esters are:

| Sorbitan Ester | HLB |
|---|---|
| Sorbitan Isostearate | 4.7 |
| Sorbitan Laurate | 8.6 |
| Sorbitan Monostearate NF | 4.7 |
| Sorbitan Oleate | 4.3 |
| Sorbitan Sesquioleate | 3.7 |
| Sorbitan Stearate (and) Sucrose Cocoate | 6 |
| Sorbitan Sesquicaprylat | 10 |
| Sorbitan Sesquioctanoate | 10 |
| Sorbitan Trioleate | 1.8 |
| PEG-40 Sorbitan Peroleate | 9 |

As mentioned before, it is important for the present invention to mix the biosurfactants A1) and the sorbitan esters A2) in the right ratio to ensure the right polarity of the composition and to avoid unnecessary cost due to excessive use of biosurfactants. Therefore the weight ratio of the sum of all biosurfactants A1) to the sum of all sorbitan esters A2) is in a range of from 0.01 to 1.2, preferably 0.1 to 1.1, more preferred 0.1 to 1, even more preferred 0.15 to 0.9 and most preferred 0.2 to 0.8.

As also mentioned before, the cleaning compositions of the invention should be mild to skin and it has to be ensured that the biosurfactants and sorbitan esters are hydrolytically stable. Therefore, the pH value of the cleaning composition is in the range of from 3 to 10, preferably 4 to 9, more preferred 5 to 8, even more preferred 6 to 8 and most preferred 6.5 to 7.5.

Within the context of the present invention, biosurfactants are understood as meaning all glycolipids produced by fermentation.

Raw materials for producing the biosurfactants that can be used are carbohydrates, in particular sugars such as e.g. glucose and/or lipophilic carbon sources such as fats, oils, partial glycerides, fatty acids, fatty alcohols, long-chain saturated or unsaturated hydrocarbons. Preferably, in the compositions according to the invention, no biosurfactants are present which are not produced by fermentation of glycolipids, such as e.g. lipoproteins.

Preferably, the composition according to the invention has, as biosurfactants, rhamnolipids, sophorolipids, glucoselipids, celluloselipids, mannosylerythritol lipid and/or trehaloselipids and mixtures thereof. The biosurfactants, in particular glycolipid surfactants, can be produced e.g. as in EP 0 499 434, U.S. Pat. No. 7,985,722, WO 03/006146, JP 60 183032, DE 19648439, DE 19600743, JP 01 304034, CN 1337439, JP 2006 274233, KR 2004033376, JP 2006 083238, JP 2006 070231, WO 03/002700, FR 2740779, DE 2939519, U.S. Pat. No. 7,556,654, FR 2855752, EP 1445302, JP 2008 062179 and JP 2007 181789 or the documents cited therein. Suitable biosurfactants can be acquired e.g. from Soliance, France.

More preferred, the composition according to the invention comprise, as biosurfactants, rhamnolipids, in particular mono-, di- or polyrhamnolipids and/or sophorolipids; most preferred are sophorolipids. Particularly preferably, the composition according to the invention has one or more sophorolipids described in EP 1 445 302 A.

The inventors found out, that particularly at nearly neutral pH values, the cleaning properties of the compositions of the present invention could be improved, if biosurfactants in lactone form are comprised in the cleaning composition. As will be shown in the examples below, compositions having a pH value of from 5 to 8 and comprising the biosurfactants with at least 30% of sum of all biosurfactants being in the lactone form show better purification performance than analogue compositions with the biosurfactants in its pure acid form. As consequence it is preferred, that composition according to the present invention comprise as component A1) a mixture comprising at least one biosurfactant A1a) in the acid form and at least one biosurfactant A1 l) in lactone form wherein the weight ratio of the sum of all biosurfactants A1a) to the sum of all biosurfactants A1 l) is in the range of from 10 to 95 A1a) to 80 to 20 A1 l), preferably 10 to 90 A1a) to 70 to 30 A1 l), more preferred 15 to 85 A1a) to 60 to 40 A1 l). If the lactone content is too high, solubility problems may occur since the lactone form is more hydrophobic than the acid form.

It is further preferred if compositions comprising A1a) and A1 l) have a pH value in the range of from 4 to 9, preferably 5 to 8, more preferred 6 to 8 and most preferred of from 6.5 to 7.5.

The composition according to the invention further comprise one or more surfactant(s) A3) which is/are neither a biosurfactants nor a sorbitan ester. Surfactant A3) is necessary to ensure sufficient solubility of the surfactant mixture, to its aqueous stability and also contributes to set the hydrophobicity. In some cases mixing components A1) and A2) in a ratio as claimed in claim 1 leads to incomplete dissolution of the water insoluble sorbitan ester A2). To full dissolution an organic solvent D) may be added and/or the surfactant A3) might be used in an appropriate amount. Preferably, therefore, the weight ratio of the sum of all surfactants A3) to the sum of all sorbitan esters A2) is between 0.5 and 10, preferably 0.5 to 8, more preferred below 1 to 5, even more preferred 1 to 4 and most preferred 1 to 3.5.

It is further preferred that the weight ratio of the sum of all biosurfactants A1) to the sum of all surfactants A3) is in a range of from 0.01 to 1, preferably 0.05 to 0.8, more preferred 0.05 to 0.6 even more preferred 0.1 to 0.5 and most preferred 0.15 to 0.4

As surfactants A3) the composition according to the invention can comprise all known surfactants suitable in particular for hard surface cleaning, preferably non-ionic and anionic surfactants. Preferably surfactant(s) A3) is/are selected from the group consisting of alcohol ethoxylates, alkyl phenol alkoxylates, alkyl glucosides, alkyl polyglucosides, soap, linear alkyl benzene sulfonates (LAS), alkyl sodium sulfate, polyoxyethylenealkyl sulfate, alpha olefin sulfonates, internal olefin sulfonates, aryl sulfonic acid salts, alkyl sulfonic acid salts, alkyl ether sulfonic acid salts, alkylaryl sulfonic acid salts, alkyl sulfosuccinates, sodium isethionate, alkyl alkoxy carboxylates, alkyl phosphate, alkyl betaines, alkyl amido betaines, amine oxides, alkyl glycerol ethers, and mixtures thereof, more preferred they are selected from the group consisting of, alcohol ethoxylates, alkyl polyglucosides, alkyl sodium sulfate, polyoxyethylenealkyl sulfate and mixtures thereof, and most preferred they are selected from the group consisting of, alcohol ethoxylates, alkyl polyglucosides, and mixtures.

As mentioned before, it might be beneficial if solution problems occur to add an organic solvent as component D) to the composition of the present invention. It is preferred use at least one solvent selected from the group consisting of propylene glycol, dipropylene glycol, ethylene glycol, alcohols, isopropanol, diols such as 2,2,4-trimethyl-1,3-pentanediol and 2-ethyl-1,3-hexanediol, glycol ethers, glycerol, phenylethyl alcohol, and/or ethanol, limonene, and mixtures thereof.

If organic solvents are used, it is preferred that the content of component D) in the overall composition is in the range of from 0.1% to 90% by weight, more preferred of from 0.5% to 50% by weight, even more preferred form 0.5% to 20% by weight, particular preferred from 1% to 15% by weight and most preferred 2% to 12% by weight.

If it is necessary to adjust the pH value of the composition of the present invention, it is preferred that the composition further comprises at least one buffer C), preferably selected from the group consisting of citrate salts, alkali metal salts of carbonates, hydrogen carbonate, silicate, metasilicate, boric acid, phosphate. The amount of buffer needed depends on the composition and the desired pH value and can easily be found out by a man skilled in the art.

Beside of components A) to D) the composition of the present invention may comprise further ingredients that are already used in the art. Non-limiting examples are:

Dyes, for example one or more natural dye(s). Within the context of the present invention, natural dyes are understood as meaning mineral dyes or dyes obtained from plants or animals. All natural dyes can be used in the compositions according to the invention. Preferred naturally occurring dyes are, e.g. indigo, lawson, purple, carmine, kermes, alizarin, woad, crocetin, brasilin, saffron, crocetin, curcumia, curcumin, orlean, bixin, annatto, anthocyans, betanin, capsanthin, carotene, chlorophylls, carminic acid, lutein, xanthophyll, lycopene, vegetable black or caramel. Particular preference is given to using natural dyes which are obtained from plants or animals.

Particularly preferably used natural substances are bixin (E 160b), anthocyans (E 163), betanin (E 162), capsanthin (E 160c), carotene (E 160a), chlorophylls (E 140), curcumin (E 100), carminic acid (E 120), luteine (E 161b), xanthophyll, lycopene (E 160d), vegetable black (E 153) and/or caramel (E 150a).

The fraction of dyes, preferably natural dyes, in the compositions according to the invention is preferably from 0.001 to 1% by weight.

The use of natural dyes achieves better biodegradability and tolerability (mildness) of the composition according to the invention.

The composition according to the invention can have preservatives, e.g. those as are listed in the EC regulation (Regulation (EC) No. 1223/2009 of the European Parliament and of the Council of 30 Nov. 2009 on cosmetic products, Annex V). Preferred compositions according to the invention are those which comprise, as preservatives, one or a combination of the following substances: benzyl alcohol, sodium benzoate, potassium sorbate, DMDM hydantoin, formic acid, benzoic acid or polyaminopropyl biguanide. Particularly preferred compositions, however, are those which are free from preservatives, in particular free from those according to the EU Regulation.

The composition of the present invention may comprise enzymes. Preferred examples of enzymes include amylase, protease, cellulose, lipase, pullulanase, isopullulanase, isoamylase, catalase, peroxidase, and the like. The enzyme can be selected by matching appropriately in light of this substrate specificity. For example, protease may be used for proteinaceous soil, and amylase may be used for starch stains.

Chelating agents may also be comprised. Chelating agents or sequestering agent can be used to sequester multivalent ions such as $Ca^{2+}$ and $Mg^{2+}$, as these ions are detrimental to cleaning performance of surfactants. Examples of chelating agent include chemicals containing multiple groups of carboxylate functionalities such as citric acid and citrate salts, polyacrylate, ethylenediaminetetraacetic acid and salts (EDTA), diethylenetraminepentaacetic acid and salts (DTPA), hydroxyethylethylenediaminetriacetic acid and salts (HEDTA), ethylenediaminedisuccinic aicd and salts (EDDS), iminodisuccinic acid and salts (IDS), methylglycinediacetic acid and salts (MGDA), glutamic acid-N,N-diacetic acid and salts (GLDA), nitrilotriacetic acid and salts (NTA), hydroxycarboxylic acids, phosphates and the like.

Bleaching agents may also be comprised. They include peroxides which generate hydrogen peroxide in an aqueous solution, such as perborate, percarbonate, persulfate and the like.

Bleaching activators include tetra acetyl ethylenediamine (TAED), tetraacetylglycoluril (TAGU), diacetyldioxohexahydrotriadine (DADHT), glucose penta acetate (GPA), sodium nonanoyloxybenzenesulfonate (SNOBS) or the like may be used.

Other detergent auxiliary components known to those skilled in the art may be used. For example, a fluid reforming agent, neutral inorganic salts, or the like. The compositions may also comprise the composition perfume oils or fragrances.

It is preferred that the compositions of the invention have a fatty acid content below 2%, preferably below 1% most preferred below 0.5% by weight. Fatty acids may forms soap when used in cleaning applications, and soap may form precipitates with hard ions in water such as $Ca^{2+}$, $Mg^{2+}$, and the like. The precipitation of the insoluble soap salts will form a "soap scum" on the substrate surfaces, which is highly undesirable in many applications. Also, the insoluble soap salt usually forms small particulates during initial stages of precipitation in cleaning applications. These insoluble particulates have defoaming effect due to their hydrophobicity, and might lead to reduced foam, which is undesirable in applications such as hand dish wash.

A composition according to the invention can be or can be used in particular a/as hard surface cleaning, kitchen cleaning, heavy oil, preferably petro-based oil, cleaning, offshore tank and vessel cleaning, or cleaning composition for application related to onshore and offshore drilling, production and storage of crude oil.

Analytic Methods

The hydrophilic-lipophilic balance (HLB) of a surfactant is a number which expresses the ratio between water-soluble groups and oil-soluble groups in the molecule. HLB values can be calculated theoretically or determined experimentally.

For sorbitan esters, the HLB values claimed in the present invention are calculated with the formula:

$$HLB=20(1-S/A)$$

Where S is the saponification number of the ester, A is the acid number of the acid. Saponification number or saponification value is expressed by potassium hydroxide in mg required to saponify one gram of ester. It is determined according to ASTM D 5558-95 method and ISO 3657:2002 method. Acid number or acid value is the mass of potassium hydroxide in mg that is required to neutralize one gram of acid.

HLB values of mixtures of surfactants with known HLB values can be calculated using the weight fractions of each of the surfactants, namely, the sum of products of the HLB of each surfactant multiplied by the weight fraction of each surfactant.

The present invention is described by way of example in the examples listed below without any intention of limiting the invention, the scope of application of which arises from the entire description and the claims, to the embodiments specified in the examples.

EXAMPLES

Unless stated otherwise, all concentrations in the application examples are given in percent by weight. Customary formulation methods known to the person skilled in the art were used to prepare the compositions.

General Description of the Experimental Methods

Test Apparatus

Multi-channel peristaltic pump flow system as shown in FIG. 1 were used for testing the cleaning efficiency.

In the apparatus according to FIG. 1, aqueous detergent formulations are pumped by the peristaltic pump into pump channel tubes. The detergent flows through one of the channels and flush down the surface of the substrate. The substrate is pre-coated with a layer of soil that mimics the dirt/stains/oils usually encountered in a cleaning application. The removal of the soil by the detergent indicates the cleaning efficacy of the said detergent. The removal of the soil is evaluated by visual observation of the whiteness of the substrate after cleaning on a 0-100 scale.

Test Soils and Substrates

Two types of soils were tested. Soil A is petro-type soil, soil B is food-type soil.

Composition Soil A: Petro Soil

Soil type A is a mixture of

| | |
|---|---|
| Aged Motor Oil: | 78% |
| Black Charm Clay: | 15.6% |
| Carbon Black: | 1.6% |
| Linoleic Acid: | 4.8% |

Composition Soil B: Food Soil (Kitchen Soil)

| | |
|---|---|
| Crisco Shortening: | 44.5% |
| Flour | 30.0% |
| Carbon Black | 0.5% |
| Stearic Acid | 10.0% |
| Powdered Egg | 15.0% |

Substrate Type:

Two types of substrates were used for testing. The first type is metal; the second type is laminate kitchen top.

Raw Materials Used

TABLE 1

List of raw materials used:

| INCI name: | Trade name: | Short Cut |
|---|---|---|
| | Biosurfactant A1: | |
| Sophorolipid biosurfactant | REWOFERM ® SL 446, Evonik Industries AG (Acid/Lactone ratio 60:40) | SL 446 |
| Sophorolipid biosurfactant | REWOFERM ® SL ONE, Evonik Industries AG (Acid/Lactone ratio 60:40) | SL ONE |
| Sophorolipid biosurfactant | SL 18 from Ecover (Acid/Lactone ratio 70:30) | SL 18 |
| Sophorolipid biosurfactant | SL Acid from Evonik Industries AG (Pure acid form) | SL Acid |
| | Sorbitan Ester A2: | |
| Sorbitan sesquioctanoate (HLB~10) | TEGOTENS ® SD 100, Evonik Industries AG | TT SD 100 |
| Sorbitan oleate (HLB 4.3) | Tego ® SMO V, Evonik Industries AG | SMO V |
| Polysorbate 20 (HLB = 16.7) | Tego ® SML 20, Evonik Industries AG | Tego SML 20 |
| | Surfactants A3: | |
| Cocamidopropyl betaine | TEGO ® Betain C 60, Evonik Industries AG, | TB C 60 |
| Alcohol ethoxylate | TEGOTENS ® EC 11, Evonik Industries AG | TT EC 11 |
| Alkyl polyglucoside | Glucopon ® 425 N, BASF SE | 425N |
| Sodium lauryl ethersulfate | Texapon ® N 70, BASF SE | N 70 |
| | Buffer C: | |
| Trisodium citrate | Product number W302600, Sigma-Aldrich | TSC |
| Trisodium methylglycinediacetate | Trilon M, BASF SE | MGDA |

Example 1

The cleaning performance of a composition according to the invention, comprising a sophorolipid (surfactant A1)+a sorbitan ester (surfactant A2)+an alcohol ethoxylate (surfactant A3), was tested in comparison to a composition comprising only a sophorolipid (surfactant A1)+an alcohol ethoxylate (surfactant A3) respectively to a composition comprising only the sophorolipid (surfactant A1). The pH value of all compositions was 7.

Test were conducted using petro-soil A on a metal surface. The formulation of the compositions are shown in Table 2.

TABLE 2

| Components | Weight percentage % |
|---|---|
| Example 1 | |
| A1) SL 446 | 0.12 |
| A2) TT SD 100 | 0.28 |
| A3) TT EC 11 | 0.60 |
| C) TSC | 1 |
| B) Water | 98 |
| Comparison Example 1 | |
| A1) SL 446 | 0.40 |
| A3) TT EC 11 | 0.60 |
| C) TSC | 1 |
| B) Water | 98 |

TABLE 2-continued

| Components | Weight percentage % |
|---|---|
| Comparison Example 2 | |
| A1) SL 446 | 1 |
| C) TSC | 1 |
| B) Water | 98 |

Figure 2:
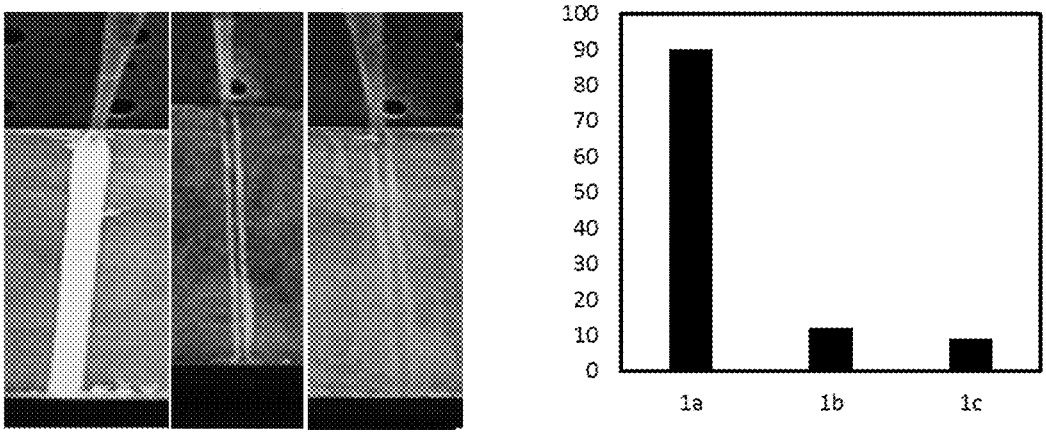
FIG. 2 shows test results from Example 1.

As shown in FIG. 2, Comparison Examples 1 and 2 showed poor cleaning performance while in Example 1 good cleaning performances was observed. Since the composition of all three Examples only differ in the contents of the surfactants A1, A2 and A3, and all test were conducted under identical conditions, it could be demonstrated, that removing the sorbitan esters A2 in the formulation leads to a significant decrease in cleaning performance. There is a synergistic effect of all three surfactants, wherein the sorbitan ester works as a hydrophobic surfactant or lipophilic linker and enhances cleaning of oily soil while the surfactants A1 and A3 contribute to the cleaning performance, too, but in addition ensure sufficient solubility of the mixture in water. Even the binary mixture in Comparison Example 1 seems to be too hydrophilic, and lacks the power to emulsify and solubilize heavy oily soil.

Example 2

The cleaning performance of a composition according to the invention, comprising a sophorolipid (surfactant A1)+a sorbitan ester (surfactant A2)+an alcohol ethoxylate (surfactant A3), was tested with petro-soil A on a metal surface in comparison to three commercial products/Reference Cleaners 1 to 3).

Reference Cleaner 1: Ecover all purpose cleaner

Reference Cleaner 2: Method dish wash,

Reference Cleaner 3: Method all purpose cleaner.

The Reference Cleaners were tested as received without further dilution. The reference cleaner 1 and 2 had a pH value of 7, and the reference cleaner 3 had a pH value of 11.5.

The formulation of the composition of Example 2 is shown in Table 3.

TABLE 3

| Components | Weight percentage % |
|---|---|
| Example 2 | |
| A1) SL 446 | 0.12 |
| A2) TT SD 100 | 0.28 |
| A3) TT EC 11 | 0.60 |
| C) TSC | 1 |
| B) Water | 98 |
| pH | 7 |

Figure 3:
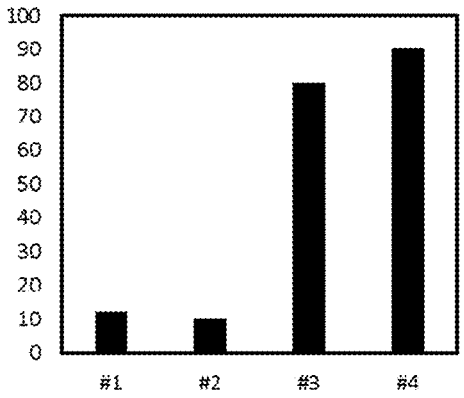
FIG. 3 shows test results from Example 2.

The cleaning performance at 1-4 min as measured with the peristaltic pump flow system were shown in FIG. 3 (#1=Reference Cleaner 1; #2=Reference Cleaner 2; #3=Reference Cleaner 3; #4=Example 2). The whiteness after cleaning was rated on a 0-100 scale. It can be seen, that the cleaning composition of the present invention showed the best cleaning performance.

Example 3

The cleaning performance of a composition according to the invention, comprising a sophorolipid (surfactant A1)+a sorbitan ester (surfactant A2)+an alkyl polyglucoside (surfactant A3), was tested with food-soil B on a laminate surface.

The formulation with the composition in Table 4 was prepared. The formulation contains 1% surfactant actives as cleaning agent (sum A1, A2 and A3) and 1% trisodium citrate.

TABLE 4

| Components | Weight percentage % |
|---|---|
| Example 3 | |
| A1) SL 446 | 0.12 |
| A2) TT SD 100 | 0.28 |
| A3) 425N | 0.60 |
| C) TSC | 1 |
| B) Water | 98 |
| pH | 7 |

The prepared formulation of Example 3 was tested using the multichannel peristatic pump flow system shown in FIG. 1, with Soil B food-type soil, and laminate kitchen top substrate. The cleaning performance of inventive formulation was compared against a commercial home care cleaner with high pH value (Reference Cleaner 4):

Reference Cleaner 4: Cleaner Rewoquat CQ 100 G with pH 10

The cleaner of Example 3 at pH 7 shows comparable performance to the commercial high pH Reference Cleaners 3 and 4.

Example 4

Example 3 was repeated with a different biosurfactants A1.

The formulation with the composition in Table 5 were prepared. In this example, SL ONE instead of SL 446 as in Example 3 was used as Surfactant A1. SL ONE is a bleached version of SL 446. The composition and acid/lactone ratio of SL ONE is the same as SL 446. The formulation contained 1% surfactant actives as cleaning agent. The concentration of trisodium citrate was tested at 1% and 0.2%, the water hardness was tested at deionized water and tap water.

TABLE 5

| Components | Weight percentage % |
|---|---|
| Example 4a | |
| A1) SL ONE | 0.12 |
| A2) TT SD 100 | 0.28 |
| A3) 425N | 0.60 |
| C) TSC | 1 |
| B) Deionized Water | 98 |
| pH | 7 |
| Example 4b | |
| A1) SL ONE | 0.12 |
| A2) TT SD 100 | 0.28 |
| A3) 425N | 0.60 |
| C) TSC | 0.2 |
| B) Deionized Water | 98.8 |
| pH | 7 |
| Example 4c | |
| A1) SL ONE | 0.12 |
| A2) TT SD 100 | 0.28 |
| A3) 425N | 0.60 |
| C) TSC | 0.2 |
| B) Tap Water | 98.8 |
| pH | 7 |

Figure 4:
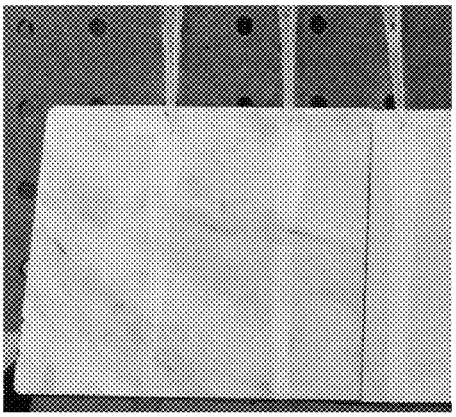
FIG. 4 shows test results from Example 4.
Figure 4:
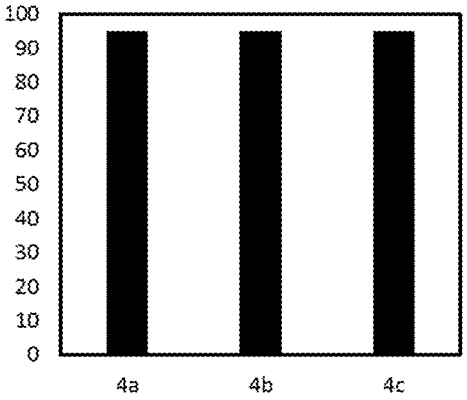

The prepared formulations were tested using the multi-channel peristatic pump flow system (FIG. 1), with Soil B food-type soil, and laminate kitchen top substrate. As shown in FIG. 4, all inventive Cleaners of Examples 4a to 4c at pH 7 show good cleaning performances.

Even though the cleaning compositions of Examples 4a to 4c have a neutral pH value, the whiteness after cleaning achieved with the inventive cleaners was comparable to that of above described commercial Reference Cleaner 4 which is strong alkaline, i.e. has a pH value of 10.

In addition, it could be shown that good cleaning can be obtained under different concentrations of trisodium citrate and for different water hardness. This indicates that it is practically suitable to combine this surfactant blends with different concentrations of chelating agents, and good cleaning can be achieved regardless of varying water hardness.

Example 5

Example 4 was repeated with a different surfactant A3.

The formulation with the compositions in Table 6 were prepared. Again, the formulation contained 1% surfactant actives as cleaning agent. The concentration of trisodium citrate was tested at 1% and 0.2%, the water hardness was tested at deionized water and tap water.

The prepared formulations were tested using the multi-channel peristatic pump flow system (FIG. 1), with Soil B food-type soil, and laminate kitchen top substrate.

TABLE 6

| Components | Weight percentage % |
|---|---|
| Example 5a | |
| A1) SL ONE | 0.12 |
| A2) TT SD 100 | 0.28 |
| A3) TT EC 11 | 0.60 |
| C) TSC | 1 |
| B) Deionized Water | 98 |
| pH | 7 |
| Example 5b | |
| A1) SL ONE | 0.12 |
| A2) TT SD 100 | 0.28 |
| A3) TT EC 11 | 0.60 |
| C) TSC | 0.2 |
| B) Deionized Water | 98.8 |
| pH | 7 |
| Example 5c | |
| A1) SL ONE | 0.12 |
| A2) TT SD 100 | 0.28 |
| A3) TT EC 11 | 0.60 |
| C) TSC | 0.2 |
| B) Tap Water | 98.8 |
| pH | 7 |

Figure 5:
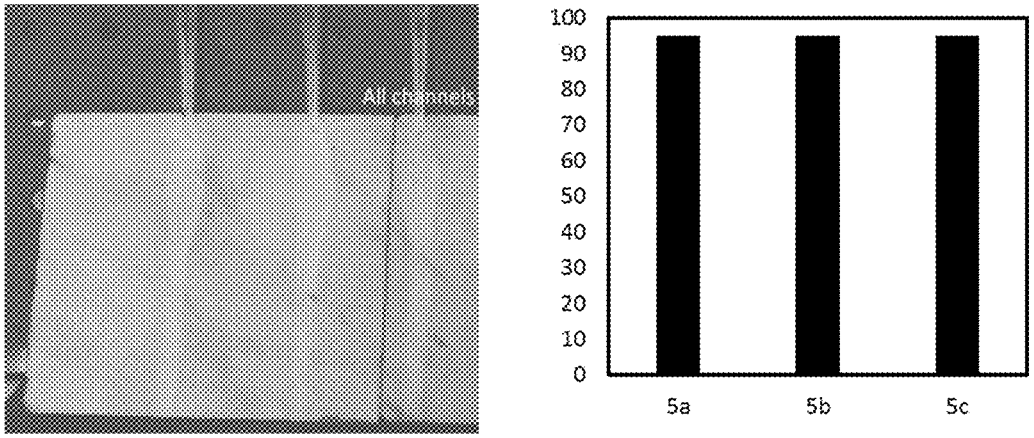

As shown in FIG. 5, the inventive compositions of Examples 5 a to c, having a pH value of 7, showed good cleaning performance. Thus, different concentrations of component c) and different water grades with different hardness values can be used in the compositions of the present invention.

Example 6

Example 5 was repeated with a different sorbitan ester A2.

The formulations with the composition in Table 7 were prepared. In this example, sorbitan ester SMO V was used instead of TT SD 100 as in Example 5. The formulation contained 1% surfactant actives as cleaning agent. The concentration of trisodium citrate was tested at 1% and 0.2%, the water hardness was tested at deionized water and tap water.

TABLE 7

| Components | Weight percentage % |
|---|---|
| Example 6a | |
| A1) SL ONE | 0.12 |
| A2) SMO V | 0.28 |
| A3) TT EC 11 | 0.60 |
| C) TSC | 1 |
| B) Deionized Water | 98 |
| pH | 7 |
| Example 6b | |
| A1) SL ONE | 0.12 |
| A2) SMO V | 0.28 |
| A3) TT EC 11 | 0.60 |
| C) TSC | 0.2 |
| B) Deionized Water | 98.8 |
| pH | 7 |
| Example 6c | |
| A1) SL ONE | 0.12 |
| A2) SMO V | 0.28 |
| A3) TT EC 11 | 0.60 |
| C) TSC | 0.2 |
| B) Tap Water | 98.8 |
| pH | 7 |

The prepared formulations were tested using the multi-channel peristatic pump flow system (FIG. 1), with Soil B food-type soil, and laminate kitchen top substrate.

The compositions according to Example 6a to c) at pH 7 showed good cleaning performance. The whiteness after cleaning was comparable to that of the commercial Reference Cleaners 1 and 3. For cleaners 1 and 3, however 1.2 wt. % of surfactants had to be used while in Examples 6 a to c only 1 wt. % surfactant was used, which is a 20% reduction of the active ingredient.

Further benefit of the formulation according to the present invention over Reference Cleaners 1 and 3 are:

- Reference cleaner 1 is a pH 7 cleaner but it contains ethanol as solvent to obtain good cleaning performance. The inventive formulation as shown in Table 6 is also formulated at pH 7 and does not contain any volatile organic solvent.
- In Examples 6a to c, good cleaning is obtained under different concentrations of trisodium citrate and water hardness, indicating it is practically suitable to combine this surfactant blends with different concentrations of chelating agents, and good cleaning can be achieved regardless of varying water hardness.

Example 7

The cleaning performance of a composition according to the invention, comprising a sophorolipid (surfactant A1)+a sorbitan ester (surfactant A2)+an alcohol ethoxylates (surfactant A3), was tested in comparison to a composition according to WO 2016/050439 comprising only a sophorolipid (surfactant A1)+a betaine (surfactant A3). The pH value of all compositions was 7.

Petro-soil A on a metal surface was used for testing. The formulation of the compositions are shown in Table 8.

TABLE 8

| Components | Weight percentage % |
|---|---|
| Example 7 | |
| A1) SL ONE | 0.12 |
| A2) TT SD 100 | 0.28 |
| A3) TB C 60 | 0.60 |
| C) TSC | 1 |
| B) Water | 98 |
| Comparison Example 3 according to WO 2016/050439 | |
| A1) SL 18 | 1.5 |
| A3) N 70 | 7.0 |
| A3) TB C 60 | 1.5 |
| B) Water | 90 |

The prepared formulation according to Example 7 was tested using the multichannel peristatic pump flow system (FIG. 1). The results were compared to Comparison Example 3. Even though in Comparison Example 3 a concentrated detergent, i.e. 10% active content, was used, it was found, that the diluted inventive cleaning agent showed much better cleaning properties. The cleaning agent of WO2016/050439 did not perform well.

Example 8

Example 5 was repeated with a different surfactant A3.

The formulations with the composition in Table 9 were prepared. In this Example sodium lauryl ether sulfate (3 mol EO) was used as surfactant A3. The formulation contained 1% surfactant actives as cleaning agent. The concentration of trisodium citrate was tested at 1% and 0.2%, the water hardness was tested at deionized water and tap water.

TABLE 9

| Components | Weight percentage % |
|---|---|
| Example 8a | |
| A1) SL ONE | 0.12 |
| A2) TT SD 100 | 0.28 |
| A3) sodium lauryl ether sulfate (3 mol EO) | 0.60 |
| C) TSC | 1 |
| B) Deionized Water | 98 |
| pH | 7 |
| Example 8b | |
| A1) SL ONE | 0.12 |
| A2) TT SD 100 | 0.28 |
| A3) sodium lauryl ether sulfate (3 mol EO) | 0.60 |
| C) TSC | 0.2 |
| B) Deionized Water | 98.8 |
| pH | 7 |
| Example 6c | |
| A1) SL ONE | 0.12 |
| A2) TT SD 100 | 0.28 |
| A3) sodium lauryl ether sulfate (3 mol EO) | 0.60 |
| C) TSC | 0.2 |
| B) Tap Water | 98.8 |
| pH | 7 |

The prepared formulations were tested using the multichannel peristatic pump flow system (FIG. 1), with Soil B food-type soil, and laminate kitchen top substrate.

The Compositions according to Example 8a to c) showed good cleaning performance, as the whiteness after cleaning shows.

In Examples 8a to c, good cleaning is obtained under different concentrations of trisodium citrate and water hardness, indicating it is practically suitable to combine this surfactant blends with different concentrations of chelating agents, and good cleaning can be achieved regardless of varying water hardness.

Example 9

This example demonstrates the effects of using different ratios of surfactants A1 to A2 and A3.

The cleaning performance of a composition according to the invention comprising a sophorolipid (surfactant A1)+a sorbitan ester (surfactant A2)+a further surfactant (surfactant A3) was tested with petro soil A on a metal surface.

The formulations with the composition in Table 10 were prepared. For cleaning tests the formulations of Table 10 were diluted with water to an active ingredients content of 1%. Sodium citrate was added to adjust the pH value of the test solutions to a pH value of 7.

TABLE 10

| Components | Weight percentage % |
|---|---|
| Example 9a | |
| A1) SL 446 | 4 |
| A2) TT SD 100 | 10 |
| A3) TT EC 11 | 20 |
| D) Propylene glycol | 4 |
| B) Water | 62 |
| Example 9b | |
| A1) SL 446 | 8 |
| A2) TT SD 100 | 10 |
| A3) TT EC 11 | 20 |
| D) Propylene glycol | 8 |
| B) Water | 54 |
| Example 9c | |
| A1) SL 446 | 2.4 |
| A2) TT SD 100 | 10 |
| A3) TT EC 11 | 20 |
| A3) TB C 60 | 2 |
| D) Propylene glycol | 4 |
| B) Water | 61.6 |

Stability tests of the concentrated solutions were very positive. Also, the diluted compositions showed good aqueous stability. Example 9b, with the highest concentration of sophorolipids showed the best aqueous stability.

Example 9c with good stability but with the lowest ratio of surfactant A1 to A3 showed the best wetting performance of the metal surface.

The ratio of surfactant A3 to A2 was comparable in Examples 9a to 9c.

Examples 9a to c show, that the ratios of components A1 to A3 and the overall contents of components A1, A2 and A3 can be varied in the ranges claimed in the dependent and independent claims of the present invention. Depending on the requirements of the intended application, e.g. aqueous stability and cleaning performance, a man skilled in the art can fine-tune the compositions.

Example 10

In this example the effects of using a biosurfactants in its pure acid form or in a mix of acid and lactone form are demonstrated.

In Example 10 a sophorolipid without lactone form at pH 7 was compared to a sophorolipid containing 60% acid and 40% lactone at pH 7.

The formulations with the composition in Table 11 were prepared.

TABLE 11

| Components | Weight percentage % |
|---|---|
| Example 10a | |
| A1) SL Acid (pure acid form) | 0.12 |
| A2) TT SD 100 | 0.28 |
| A3) TT EC 11 | 0.60 |
| C) TSC | 1 |
| B) Water | 98 |
| pH | 7 |
| Example 10b | |
| A1) SL ONE | 0.12 |
| A2) TT SD 100 | 0.28 |
| A3) TT EC 11 | 0.60 |
| C) TSC | 1 |
| B) Water | 98 |
| pH | 7 |

Figure 6:
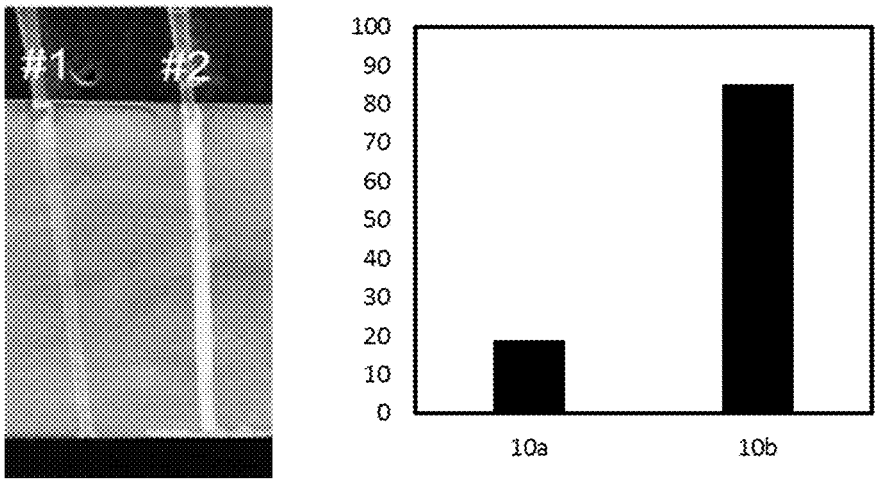

As shown in FIG. 6, cleaning tests revealed, that at pH 7, a sophorolipid with a lactone fraction (Example 10b) showed better cleaning performance than sophorolipids without lactone fraction as used in Example 10a.

These results show that at mild pH conditions sophorolipids with lactone fraction are beneficial compared to those without lactone fraction.

Example 11

In Example 11 several comparison test were conducted, wherein

- Non inventive hydrophilic sorbitan esters were used (comparative example 4)
- Non inventive ratios of A1 to A2 were used were used (Comparative Examples 5 and 6)
- Non inventive ratios of A1 to A2 as well as non inventive hydrophilic sorbitan esters were used (Comparative Examples 7 and 8)

In detail:

Comparison Example 4

Example 5a was repeated with a non inventive hydrophilic sorbitan ester A2 (Example 5a with HLB~10; Comparison Example 4 with HLB 16.7)

Comparison Examples 5 and 6

Example 5a was repeated with non inventive ratios of A1 to A2

Comparison Example 7 and 8

Example 5a was repeated with a hydrophilic, non inventive sorbitan ester A2 (Example 5a with HLB~10; Comparison Examples 6 and 7 with HLB 16.7). In addition, non inventive ratios of A1 to A2 were used.

The formulations with the composition in Table 12 were prepared.

TABLE 12

| Components | Weight percentage % |
|---|---|
| Comparative Example 4 | |
| A1) SL ONE | 0.12 |
| A2) Tego SML 20 | 0.28 |
| A3) TT EC 11 | 0.60 |
| C) TSC | 1.0 |
| B) Deionized Water | 98 |
| pH | 7 |
| Comparative Example 5 | |
| A1) SL ONE | 0.22 |
| A2) TT SD 100 | 0.18 |
| A3) TT EC 11 | 0.60 |
| C) TSC | 1.0 |
| B) Deionized Water | 98 |
| pH | 7 |
| Comparative Example 6 | |
| A1) SL ONE | 0.30 |
| A2) TT SD 100 | 0.10 |
| A3) TT EC 11 | 0.60 |
| C) TSC | 1.0 |
| B) Tap Water | 98 |
| pH | 7 |
| Comparative Example 7 | |
| A1) SL ONE | 0.22 |
| A2) Tego SML 20 | 0.18 |
| A3) TT EC 11 | 0.60 |
| C) TSC | 1.0 |
| B) Tap Water | 98 |
| pH | 7 |
| Comparative Example 8 | |
| A1) SL ONE | 0.30 |
| A2) Tego SML 20 | 0.10 |
| A3) TT EC 11 | 0.60 |
| C) TSC | 1.0 |
| B) Tap Water | 98 |
| pH | 7 |

Figure 7:
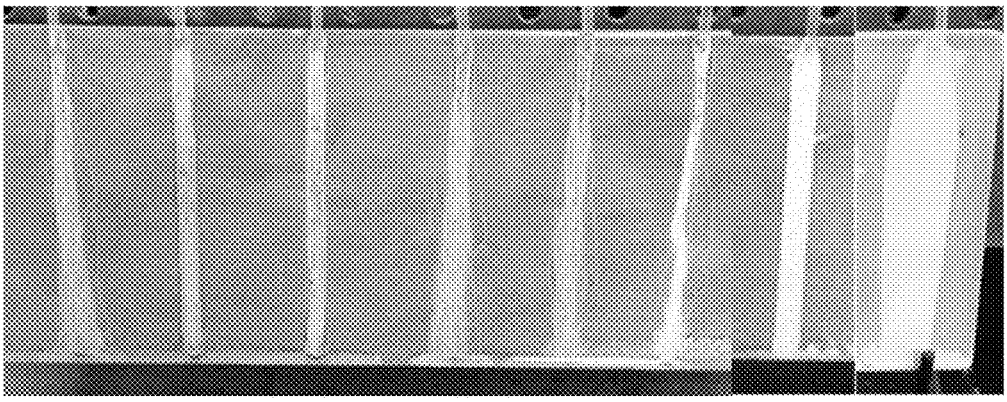
Figure 7:
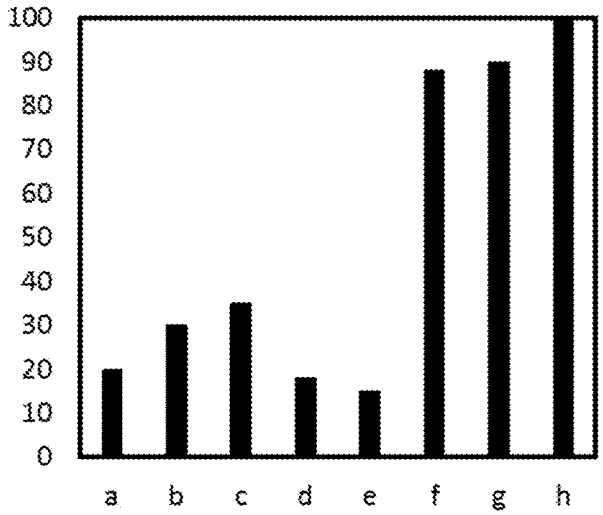

As can be seen in FIGS. 5 and 7, the inventive formulation with a hydrophobic sorbitan ester as well as with a low ratio of biosurfactant A1 to sorbitan ester A2 show the best cleaning performances. The worst cleaning performance was found in comparative examples 7 and 8 wherein a hydrophilic sorbitan ester and a high ratio of biosurfactant A1 to sorbitan ester A2 was used. If only a hydrophilic sorbitan ester (comparative example 4) was used or if only the ratio of biosurfactant A1 to sorbitan ester A2 was higher than claimed in the present invention (Comparative Example 5 and 6) the cleaning performance was worse than in Example 5a but not as worse as in Comparative Examples 7 and 8. This shows the synergistic effect of using a sorbitane ester with and HLB value according to the present invention and simultaneously using a ratio of biosurfactant A1 to sorbitan ester A2 according to the invention.

Example 12

A test of a cleaning composition according to the invention with a very low surfactant content was done in Example 12a while in Example 12b a cleaning composition with a very high surfactant content was tested. The composition in Table 13 were prepared.

TABLE 13

| Components | Weight percentage % |
|---|---|
| Example 12a | |
| A1) SL ONE | 0.012 |
| A2) TT SD 100 | 0.028 |
| A3) TT EC 11 | 0.060 |
| C) TSC | 1.0 |
| B) Tap Water | 98.9 |
| pH | 7 |
| Example 12b | |
| A1) SL ONE | 1.2 |
| A2) TT SD 100 | 2.8 |
| A3) TT EC 11 | 6.0 |
| C) TSC | 1.0 |
| B) Tap Water | 89 |
| pH | 7 |

As shown in FIG. 7 the inventive cleaning compositions show very good cleaning performances with very high as well as with very low contents of surfactants.

The invention claimed is:

1. A composition comprising:

A) a mixture of surfactants A1, A2 and A3;

B) optionally water;

wherein:

the mixture of surfactants comprises:

A1: one or more sophorolipid biosurfactants;

A2: one or more sorbitan esters selected from the group consisting of: sorbitan sesquioctanoate; sorbitan oleate; and polysorbate 20;

A3: one or more further surfactants different from surfactants A1 and A2 and selected from the group consisting of: an alcohol ethoxylate; an alkyl polyglucoside; and sodium lauryl ethersulfate;

the weight ratio of the sum of all biosurfactants A1 to the sum of all sorbitan esters A2 is in a range of from 0.01 to 1.2;

the pH value of the cleaning composition is in the range of from 3 to 10;

and wherein the composition is a hard surface cleaning composition, kitchen cleaning composition, heavy oil cleaning composition, offshore tank and vessel cleaning composition, or cleaning composition for an application related to onshore and offshore drilling, production and storage of crude oil.

2. The composition of claim 1, wherein:

the weight ratio of the sum of all biosurfactants A1 to the sum of all surfactants A3 is in a range of from 0.01 to 1; and/or the weight ratio of the sum of all surfactants A3 to the sum of all sorbitan esters A2 is between 1 and 10.

3. The composition of claim 1, wherein the fraction of component A comprising a mixture of components A1, A2 and A3 is from 0.1 to 100% by weight of the overall composition.

4. The composition of claim 1, wherein the composition further comprises one or more biosurfactants selected from the group consisting of: rhamnolipids; glucoselipids; celluloselipids; trehaloselipids; mannosylerythritol lipid; and mixtures thereof.

5. The composition of claim 1, wherein the biosurfactant(s) A1 comprise a mixture of at least one biosurfactant A1a in the acid form and at least one biosurfactant A1l in lactone form wherein the weight ratio of the sum of all biosurfactants A1a to the sum of all biosurfactants A1l is in the range of from 10 to 95.

6. The composition of claim 1, wherein the composition further comprises one or more surfactants selected from the group consisting of: sorbitan isostearate; sorbitan laurate; sorbitan monostearate; sorbitan sesquioleate; sorbitan stearate and sucrose cocoate; sorbitan sesquioctanoate; sorbitan trioleate; PEG-40 sorbitan peroleate; and mixtures thereof.

7. The composition of claim 1, wherein the composition further comprises one or more surfactants selected from the group consisting of: alkyl phenol alkoxylates; alkyl glucosides; soap; linear alkyl benzene sulfonates (LAS); alkyl sodium sulfate; polyoxyethylenealkyl sulfate; alpha olefin sulfonates; internal olefin sulfonates; aryl sulfonic acid salts; alkyl sulfonic acid salts; alkylaryl sulfonic acid salts; alkyl sulfosuccinates; sodium isethionate; alkyl alkoxy carboxylates; alkyl phosphate; alkyl betaines; alkyl amido betaines; amine oxides; alkyl glycerol ethers; and mixtures thereof.

8. The composition of claim 1, further comprising at least one buffer C, selected from the group consisting of: citrate salts; alkali metal salts of carbonates; hydrogen carbonate; silicate; metasilicate; boric acid; and phosphate.

9. The composition of claim 1, further comprising at least one organic solvent D.

10. The composition of claim 9, wherein the organic solvent is selected from the group consisting of: propylene glycol; dipropylene glycol; ethylene glycol; alcohols; isopropanol; diols; glycol ethers; glycerol; phenylethyl alcohol and/or ethanol; limonene; and mixtures thereof.

11. The composition of claim 1, wherein the composition consists of:

A) a mixture of surfactants A1, A2 and A3; and

B) optionally water.

12. The composition of claim 1, wherein the ratio of A1 to A2 is 0.1-1.1.

13. The composition of claim 1, wherein the fatty acid content is below 2% by weight.

14. The composition of claim 1, wherein:

the sorbitan ester used as component A2 is sorbitan sesquioctanoate and/or sorbitan oleate;

the weight ratio of the sum of all biosurfactants A1 to the sum of all sorbitan esters A2 is in a range of from 0.15 to 0.9;

the pH value of the cleaning composition is in the range of 5 to 8.

15. The composition of claim 14, wherein:

the weight ratio of the sum of all surfactants A3 to the sum of all sorbitan esters A2 is between 1 and 5;

the weight ratio of the sum of all biosurfactants A1 to the sum of all sorbitan esters A2 is in a range of from 0.2 to 0.8;

the pH value of the cleaning composition is in the range of from 6.5 to 7.5.

16. The composition of claim 14, wherein the composition consists of A1, A2, A3 and optionally water and/or an organic solvent.

17. The composition of claim 1, wherein the composition is in contact with a hard surface, food surface or soil.

18. The composition of claim 1, further comprising a protease effective for proteins in soil or an amylase effective for starch stains.

19. The composition of claim 1, wherein:

the sorbitan ester used as component A2 is sorbitan sesquioctanoate and/or sorbitan oleate;

the weight ratio of the sum of all biosurfactants A1 to the sum of all sorbitan esters A2 is in a range of from 0.2 to 0.8; and the weight ratio of the sum of all surfactants A3 to the sum of all sorbitan esters A2 is between 1 and 3.5.

20. The composition of claim 19, wherein the fraction of component A comprising a mixture of components A1, A2 and A3 is from 0.5 to 10% by weight of the overall composition.

* * * * *